US009976554B2

(12) United States Patent
Doepker

(10) Patent No.: US 9,976,554 B2
(45) **Date of Patent: *May 22, 2018**

(54) CAPACITY-MODULATED SCROLL COMPRESSOR

(71) Applicant: Emerson Climate Technologies, Inc., Sidney, OH (US)

(72) Inventor: Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/682,044

(22) Filed: Aug. 21, 2017

(65) Prior Publication Data

US 2017/0342978 A1 Nov. 30, 2017

Related U.S. Application Data

(63) Continuation of application No. 14/278,325, filed on May 15, 2014, now Pat. No. 9,739,277.

(51) Int. Cl.

| | |
|---|---|
| ***F04C 18/00*** | (2006.01) |
| ***F04C 2/20*** | (2006.01) |
| ***F04C 2/02*** | (2006.01) |
| ***F04C 14/24*** | (2006.01) |
| ***F04C 18/02*** | (2006.01) |
| ***F04C 28/26*** | (2006.01) |
| *F04C 23/00* | (2006.01) |

(52) U.S. Cl.

CPC ..... *F04C 2/025* (2013.01); *F04C 14/24* (2013.01); *F04C 18/0215* (2013.01); *F04C 18/0261* (2013.01); *F04C 28/26* (2013.01); *F04C 23/008* (2013.01)

(58) Field of Classification Search

CPC .. F04C 14/24; F04C 18/0215; F04C 18/0261; F04C 23/008; F04C 28/26; F04C 2/025

See application file for complete search history.

(56) References Cited

U.S. PATENT DOCUMENTS 5,640,854 A * 6/1997 Fogt ..... F01C 1/0215 418/55.6
5,674,058 A * 10/1997 Matsuda ..... F04C 28/16 417/440
5,678,985 A * 10/1997 Brooke ..... F04C 28/14 417/299

(Continued)

*Primary Examiner* — Mark Laurenzi
*Assistant Examiner* — Anthony Ayala Delgado
(74) *Attorney, Agent, or Firm* — Harness, Dickey & Pierce, P.L.C.

(57) ABSTRACT

A compressor is provided and may include a first scroll member having an end plate and a spiral wrap extending from the end plate. The end plate may include a first modulation port and a second modulation port each in fluid communication with a compression pocket formed by the spiral wrap. A first modulation valve ring may be movable relative to the end plate between a first position blocking the first modulation port and a second position spaced apart from the first modulation port. A second modulation valve ring may movable relative to the end plate between a first position blocking the second modulation port and a second position spaced apart from the second modulation port. The second modulation ring may be located radially inward from the first modulation valve ring.

20 Claims, 9 Drawing Sheets

(56) References Cited

U.S. PATENT DOCUMENTS 5,722,257 A * 3/1998 Ishii ..... F04C 29/0035 418/55.5
5,741,120 A * 4/1998 Bass ..... A47F 3/04 417/44.2
5,855,475 A * 1/1999 Fujio ..... F04C 18/0215 418/15
5,885,063 A * 3/1999 Makino ..... F04C 28/12 417/310
5,993,171 A * 11/1999 Higashiyama ..... F04C 28/12 417/308
5,993,177 A * 11/1999 Terauchi ..... F04C 28/14 417/308
6,047,557 A * 4/2000 Pham ..... A47F 3/04 236/1 EA
6,095,765 A * 8/2000 Khalifa ..... F04C 28/26 417/307
6,102,671 A * 8/2000 Yamamoto ..... F04C 18/0246 417/308
6,123,517 A * 9/2000 Brooke ..... F04C 18/0215 417/299
6,139,287 A * 10/2000 Kuroiwa ..... F04C 28/16 417/299
6,149,401 A * 11/2000 Iwanami ..... F04B 27/1804 417/213
6,164,940 A * 12/2000 Terauchi ..... F04C 28/12 418/14
6,176,686 B1 * 1/2001 Wallis ..... F04C 18/0215 417/310
6,202,438 B1 * 3/2001 Barito ..... F04C 28/28 62/197
6,210,120 B1 * 4/2001 Hugenroth ..... F04C 28/06 417/310
6,213,731 B1 * 4/2001 Doepker ..... F01C 21/10 417/299
6,231,316 B1 * 5/2001 Wakisaka ..... F04C 28/12 417/310
6,273,691 B1 * 8/2001 Morimoto ..... F04C 28/16 418/15
6,293,767 B1 * 9/2001 Bass ..... F04C 23/008 417/213
6,293,776 B1 * 9/2001 Hahn ..... F04C 18/0215 418/55.4

* cited by examiner

CAPACITY-MODULATED SCROLL COMPRESSOR

CROSS-REFERENCE TO RELATED APPLICATIONS

This application is a continuation of U.S. patent application Ser. No. 14/278,325 filed on May 15, 2014. The entire disclosure of the above application is incorporated herein by reference.

FIELD

The present disclosure relates to compressor capacity modulation assemblies.

BACKGROUND

This section provides background information related to the present disclosure and which is not necessarily prior art.

Compressors may be designed for a variety of operating conditions. The operating conditions may require different output from the compressor. In order to provide for more efficient compressor operation, capacity modulation assemblies may be included in a compressor to vary compressor output depending on the operating condition.

SUMMARY

This section provides a general summary of the disclosure, and is not comprehensive of its full scope or all of its features.

A compressor is provided and may include a first scroll member having an end plate and a spiral wrap extending from the end plate. The end plate may include a first modulation port and a second modulation port each in fluid communication with a compression pocket formed by the spiral wrap. A first modulation valve ring may be movable relative to the end plate between a first position blocking the first modulation port and a second position spaced apart from the first modulation port. A second modulation valve ring may movable relative to the end plate between a first position blocking the second modulation port and a second position spaced apart from the second modulation port. The second modulation ring may be located radially inward from the first modulation valve ring.

In another configuration, a compressor is provided and may include a first scroll member having an end plate and a spiral wrap extending from the end plate. The end plate may include a first modulation port and a second modulation port each in fluid communication with a compression pocket formed by the spiral wrap. A first modulation valve ring may be movable relative to the end plate between a first position blocking the first modulation port and a second position spaced apart from the first modulation port. A second modulation valve ring may be movable relative to the end plate between a first position blocking the second modulation port and a second position spaced apart from the second modulation port. A first modulation control chamber may be formed between the first modulation valve ring and the second modulation valve ring, whereby the first modulation control chamber receives pressurized fluid to move the second modulation valve ring between the first position and the second position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a cross-sectional view of a compressor including a non-orbiting scroll member and a capacity modulation assembly according to the present disclosure;

FIG. 2*a* is a cross-sectional view of the non-orbiting scroll member and capacity modulation assembly of FIG. 1 showing the capacity modulation assembly in a full-capacity mode;

FIG. 2*b* is a cross-sectional view of the non-orbiting scroll member and capacity modulation assembly of FIG. 1 showing the capacity modulation assembly in a full-capacity mode;

FIG. 3*a* is a cross-sectional view of the non-orbiting scroll member and capacity modulation assembly of FIG. 1 showing the capacity modulation assembly in a partial reduced-capacity mode;

FIG. 3*b* is a cross-sectional view of the non-orbiting scroll member and capacity modulation assembly of FIG. 1 showing the capacity modulation assembly in a partial reduced-capacity mode;

FIG. 4*a* is a cross-sectional view of the non-orbiting scroll member and capacity modulation assembly of FIG. 1 showing the capacity modulation assembly in a full reduced-capacity mode;

FIG. 4*b* is a cross-sectional view of the non-orbiting scroll member and capacity modulation assembly of FIG. 1 showing the capacity modulation assembly in a full reduced-capacity mode;

Corresponding reference numerals indicate corresponding parts throughout the several views of the drawings.

DETAILED DESCRIPTION

Figure 1:
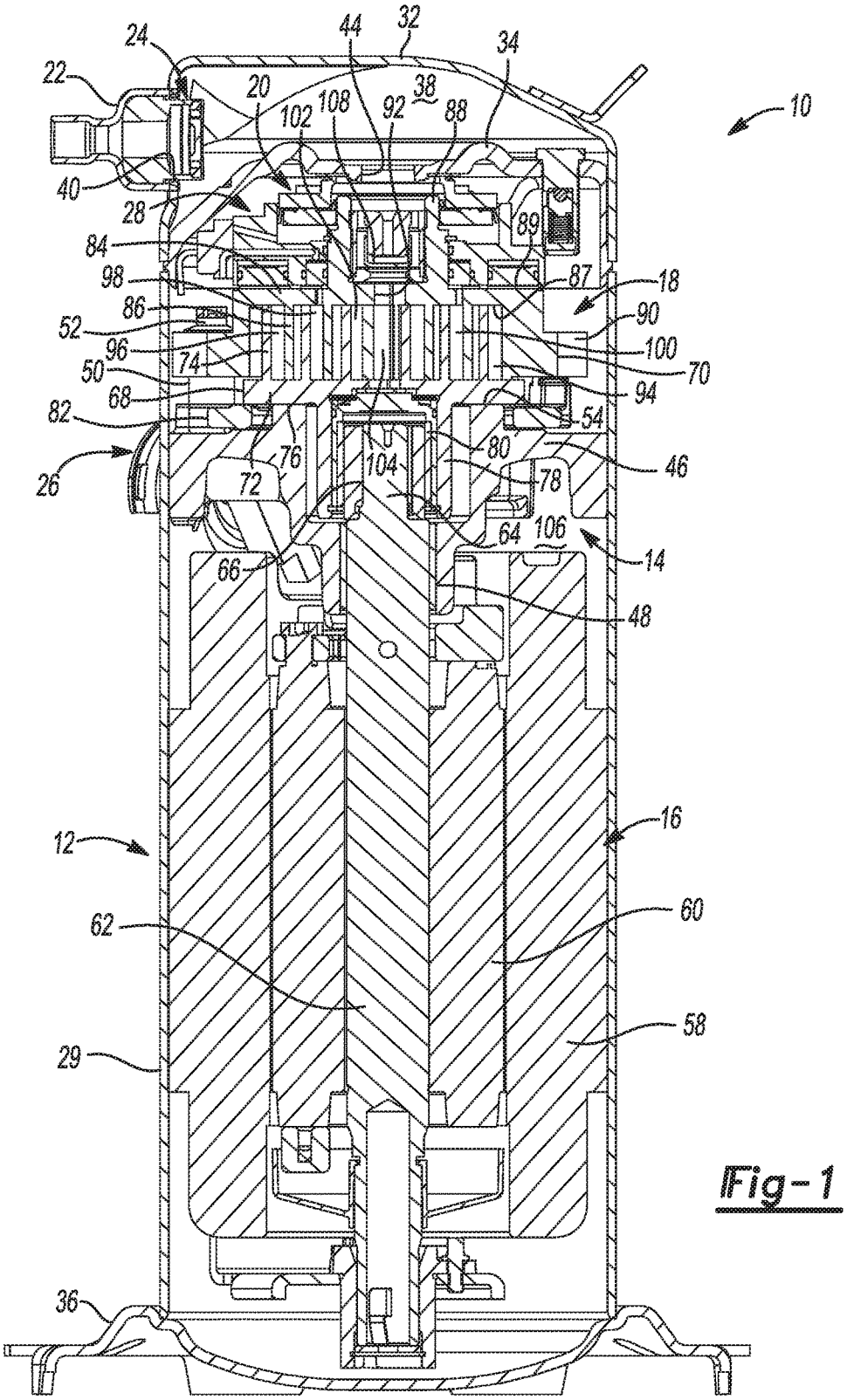

The following description is merely exemplary in nature and is not intended to limit the present disclosure, application, or uses. It should be understood that throughout the drawings, corresponding reference numerals indicate like or corresponding parts and features.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure is suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 is provided and may include a hermetic shell assembly 12, a bearing housing assembly 14, a motor assembly 16, a compression mechanism 18, a seal assembly 20, a refrigerant discharge fitting 22, a discharge valve assembly 24, a suction gas inlet fitting 26, and a capacity modulation assembly 28. As shown in FIG. 1, shell assembly 12 houses bearing housing assembly 14, motor assembly 16, compression mechanism 18, and capacity modulation assembly 28.

Shell assembly 12 may generally form a compressor housing and may include a cylindrical shell 29, an end cap 32 at the upper end thereof, a transversely extending partition 34, and a base 36 at a lower end thereof. End cap 32 and partition 34 may generally define a discharge chamber 38. Discharge chamber 38 may generally form a discharge muffler for compressor 10. While illustrated as including discharge chamber 38, it is understood that the present disclosure applies equally to direct-discharge configurations. Refrigerant discharge fitting 22 may be attached to shell assembly 12 at an opening 40 in end cap 32. Discharge valve assembly 24 may be located within discharge fitting 22 and may generally prevent a reverse-flow condition. Suction gas inlet fitting 26 may be attached to shell assembly 12. Partition 34 may include a discharge passage 44 therethrough providing communication between compression mechanism 18 and discharge chamber 38.

Bearing housing assembly 14 may be affixed to shell 29 at a plurality of points in any desirable manner, such as staking. Bearing housing assembly 14 may include a main bearing housing 46, a bearing 48 disposed therein, bushings 50, and fasteners 52. Main bearing housing 46 may house bearing 48 therein and may define an annular flat thrust bearing surface 54 on an axial end surface thereof. Main bearing housing 46 may include apertures (not shown) extending therethrough and receiving fasteners 52.

Motor assembly 16 may generally include a motor stator 58, a rotor 60, and a drive shaft 62. Motor stator 58 may be press fit into shell 29. Drive shaft 62 may be rotatably driven by rotor 60 and may be rotatably supported within first bearing 48. Rotor 60 may be press fit on drive shaft 62. Drive shaft 62 may include an eccentric crank pin 64 having a flat 66 thereon.

Compression mechanism 18 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with annular flat thrust bearing surface 54 on main bearing housing 46. A cylindrical hub 78 may project downwardly from thrust surface 76 and may have a drive bushing 80 rotatably disposed therein. Drive bushing 80 may include an inner bore in which crank pin 64 is drivingly disposed. Crank pin flat 66 may drivingly engage a flat surface in a portion of the inner bore of drive bushing 80 to provide a radially compliant driving arrangement. An Oldham coupling 82 may be engaged with the orbiting and non-orbiting scrolls 68, 70 to prevent relative rotation therebetween.

Non-orbiting scroll 70 may include an end plate 84 defining a discharge passage 92 and having a spiral wrap 86 extending from a first side 87 thereof, an annular hub 88 extending from a second side 89 thereof opposite the first side, and a series of radially outwardly extending flanged portions 90 (FIG. 1) engaged with fasteners 52. Fasteners 52 may rotationally fix non-orbiting scroll 70 relative to main bearing housing 46 while allowing axial displacement of non-orbiting scroll 70 relative to main bearing housing 46. Spiral wraps 74, 86 may be meshingly engaged with one another defining pockets 94, 96, 98, 100, 102, 104 (FIG. 1). It is understood that pockets 94, 96, 98, 100, 102, 104 change throughout compressor operation.

A first pocket 94 in FIG. 1, may define a suction pocket in communication with a suction pressure region 106 of compressor 10 operating at a suction pressure ($P_s$) and a second pocket 104 in FIG. 1, may define a discharge pocket in communication with a discharge pressure region 108 of compressor 10 operating at a discharge pressure ($P_d$) via discharge passage 92. Pockets 96, 98, 100, 102 intermediate the first and second pockets 94, 104 in FIG. 1, may form intermediate compression pockets operating at intermediate pressures between the suction pressure ($P_s$) and the discharge pressure ($P_d$).

Referring to FIGS. 2*a* through 4*b*, end plate 84 may additionally include a biasing passage 110, first and second modulation ports 112*a*, 112*b* and third and fourth modulation ports 114*a*, 114*b*. Biasing passage 110, first and second modulation ports 112*a*, 112*b* (FIG. 2A), and third and fourth modulation ports 114*a*, 114*b* (FIG. 2B) may each be in fluid communication with one of the intermediate compression pockets 96, 98, 100, 102. Biasing passage 110 may be in fluid communication with one of the intermediate compression pockets operating at a higher pressure than ones of intermediate compression pockets in fluid communication with first, second, third and fourth modulation ports 112*a*, 112*b*, 114*a*, 114*b*. Third and fourth modulation ports 114*a*, 114*b* may be in fluid communication with ones of the intermediate compression pockets operating at a higher pressure than ones of the intermediate compression pockets in fluid communication with first and second modulation ports 112*a*, 112*b*.

Annular hub 88 may include first and second portions 116, 118 axially spaced from one another forming a stepped region 120 therebetween. First portion 116 may be located axially between second portion 118 and end plate 84 and may have an outer radial surface 122 defining a first diameter ($D_1$) greater than or equal to a second diameter ($D_2$) defined by an outer radial surface 124 of second portion 118.

Capacity modulation assembly 28 may include a first modulation valve ring 126*a*, a second modulation valve ring 126*b*, a modulation lift ring 128, a retaining ring 130, a first modulation control valve assembly 132*a*, and a second modulation control valve assembly 132*b*.

First modulation valve ring 126*a* may include an inner radial surface 134, an outer radial surface 136, a first axial end surface 138 defining an annular recess 140 and a valve portion 142, first and second passages 144*a*, 144*b*, and third and fourth passages 146*a*, 146*b*. Inner radial surface 134 may include first, second, and third portions 148*a*, 148*b*, 148*c*. The first and second portions 148*a*, 148*b* may define a second axial end surface 152 therebetween while the second and third portions 148*b*, 148*c* may define a third axial end surface 153. First portion 148*a* may define a third diameter ($D_3$) greater than a fourth diameter ($D_4$) defined by the second portion 148*b*. Third portion 148*c* may define a fifth diameter ($D_5$) greater than the fourth diameter ($D_4$) and greater than the third diameter ($D_3$). The first and fourth diameters ($D_1$, $D_4$) may be approximately equal to one another and the first portion 116 of hub 88 may be sealingly engaged with the second portion 148*b* of first modulation valve ring 126*a* via a seal 154 located radially therebetween. More specifically, seal 154 may include an o-ring seal and may be located within an annular recess 156 in second portion 148*b* of first modulation valve ring 126*a*. Alternatively, ring seal 154 could be located in an annular recess (not shown) in annular hub 88.

Second modulation valve ring 126*b* may be located radially between outer radial surface 122 and the first portion 148*a* of inner radial surface 134, and located axially between the second axial end surface 152 and the second side 89 of end plate 84. Accordingly, the second modulation valve ring 126*b* may be an annular body defining inner and outer radial surfaces 155*a*, 155*b*, and first and second axial end surfaces 157*a*, 157*b*. Inner and outer radial surfaces 155*a*, 155*b* may be sealingly engaged with outer radial surface 122 of annular hub 88 and with first portion 148*a* of inner radial surface 134, respectively, via first and second seals 163*a*, 163*b*. More specifically, first and second seals 163*a*, 163*b* may include o-ring seals and may be located within respective annular recesses 165*a*, 165*b* formed in inner radial surface 155*a* of second modulation valve ring 126*b* and formed in first portion 148*a* of inner radial surface 134, respectively. First modulation valve ring 126*a* and second modulation valve ring 126*b* may cooperate to define a first modulation control chamber 174*a* between the second axial end surface 152 of the first modulation valve ring 126*a* and the first axial end surface 157*a* of the second modulation valve ring 126*b*. Third passage 146*a* may be in fluid communication with first modulation control chamber 174*a*.

Figure 5:
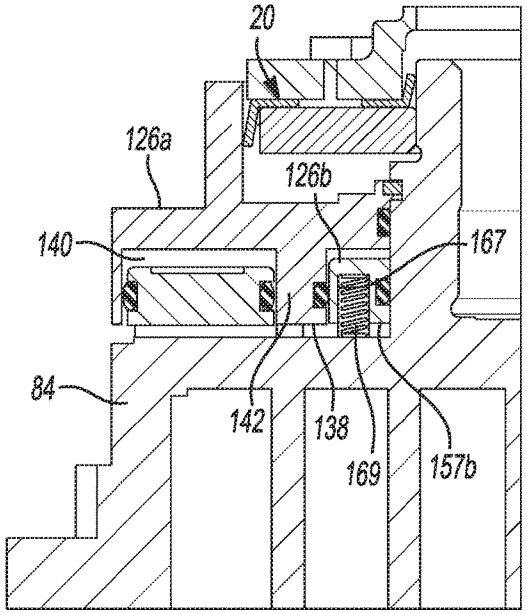
FIG. 5 is a partial cross-sectional view of the non-orbiting scroll member and capacity modulation assembly of FIG. 1, showing a biasing member of the capacity modulation assembly.

With reference to FIG. 5, the second axial end surface 157*b* of second modulation valve ring 126*b* may include a series of bores 167 and a series of biasing members 169 respectively disposed in the series of bores 167. The biasing members 169 may be helical springs that bias the second modulation valve ring 126*b* in an axial direction away from the end plate 84. More specifically, the biasing members 169 may provide a first axial force ($F_1$) between the non-orbiting scroll 70 and the second modulation valve ring 126*b*, urging the second modulation valve ring 126*b* axially away from non-orbiting scroll 70. In one configuration, second axial end surface 157*b* includes four bores 167 and four biasing members 169. While the second axial end surface 157*b* is described as including four bores 167 and four biasing members 169, the second axial end surface 157*b* may include any number of bores 167 and any number of biasing members 169.

Figure 6:
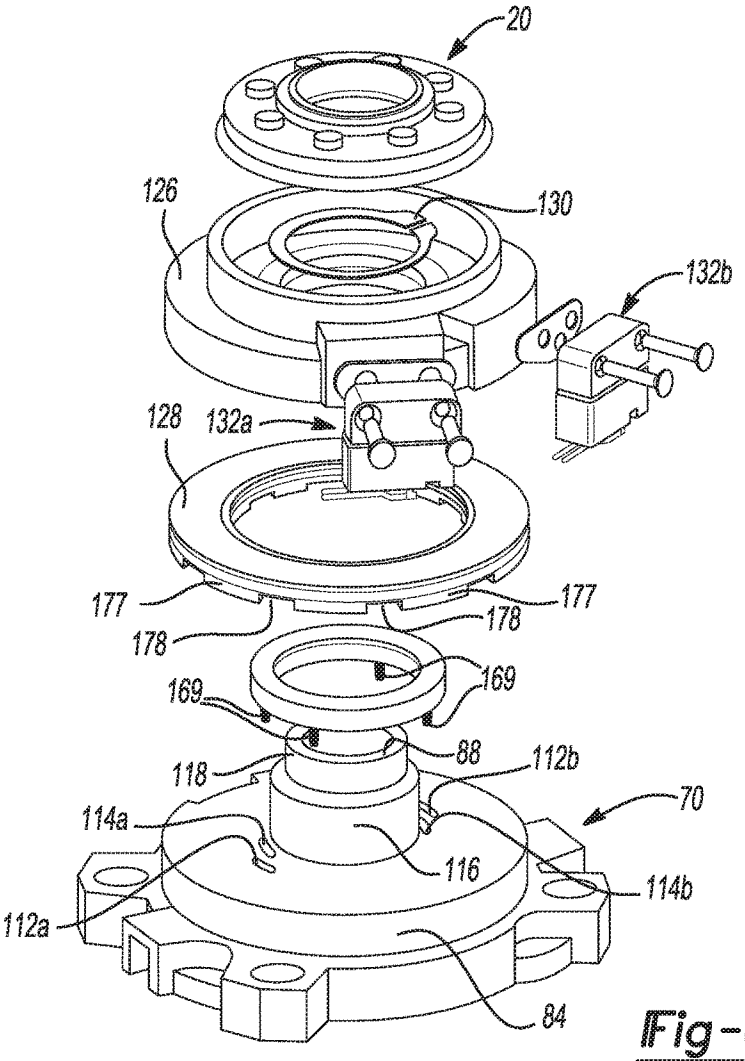
FIG. 6 is a perspective exploded view of the non-orbiting scroll member and capacity modulation assembly of FIG. 1.

With additional reference to FIGS. 2A through 4B, modulation lift ring 128 may be located within annular recess 140 and may include an annular body defining inner and outer radial surfaces 158, 160, and first and second axial end surfaces 159, 161. Inner and outer radial surfaces 158, 160 may be sealingly engaged with inner and outer sidewalls 162, 164 of annular recess 140 via first and second seals 166, 168, respectively. More specifically, first and second seals 166, 168 may include o-ring seals and may be located within annular recesses 170, 172 in inner and outer radial surfaces 158, 160 of modulation lift ring 128. First modulation valve ring 126*a* and modulation lift ring 128 may cooperate to define a second modulation control chamber 174*b* between annular recess 140 and first axial end surface 159 of modulation lift ring 128. First passage 144*a* may be in fluid communication with second modulation control chamber 174*b*. With reference to FIG. 6, second axial end surface 161 of modulation lift ring 128 may face end plate 84 and may include a series of protrusions 177 defining radial flow passages 178 therebetween.

Seal assembly 20 may form a floating seal assembly and may be sealingly engaged with non-orbiting scroll 70 and first modulation valve ring 126*a* to define an axial biasing chamber 180. More specifically, seal assembly 20 may be sealingly engaged with outer radial surface 124 of annular hub 88 and third portion 148*c* of first modulation valve ring 126*a*. Axial biasing chamber 180 may be defined axially between an axial end surface 182 of seal assembly 20 and third axial end surface 153 of first modulation valve ring 126*a*. Second passage 144*b* and fourth passage 146*b* may be in fluid communication with axial biasing chamber 180.

Retaining ring 130 may be axially fixed relative to non-orbiting scroll 70 and may be located within axial biasing chamber 180. More specifically, retaining ring 130 may be located within a recess 117 in first portion 116 of annular hub 88 axially between seal assembly 20 and first modulation valve ring 126*a*. Retaining ring 130 may form an axial stop for first modulation valve ring 126*a*.

First modulation control valve assembly 132*a* may include a solenoid-operated valve and may be in fluid communication with first and second passages 144*a*, 144*b* in first modulation valve ring 126*a* and with suction pressure region 106. Second modulation control valve assembly 132*b* may include a solenoid-operated valve and may be in fluid communication with third and fourth passages 146*a*, 146*b* in first modulation valve ring 126*a* and with suction pressure region 106.

Figure 7:
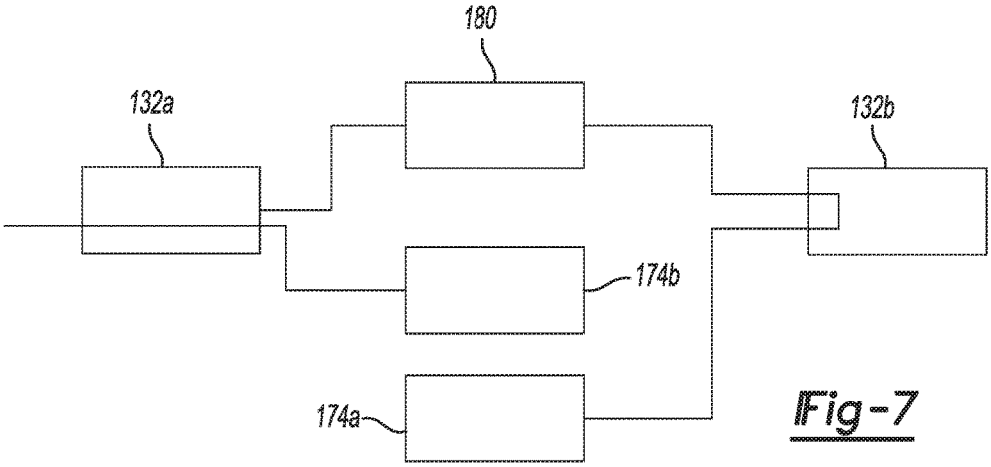
FIG. 7 is a schematic illustration of the capacity modulation assembly of FIG. 1 in a full-capacity mode.
Figure 8:
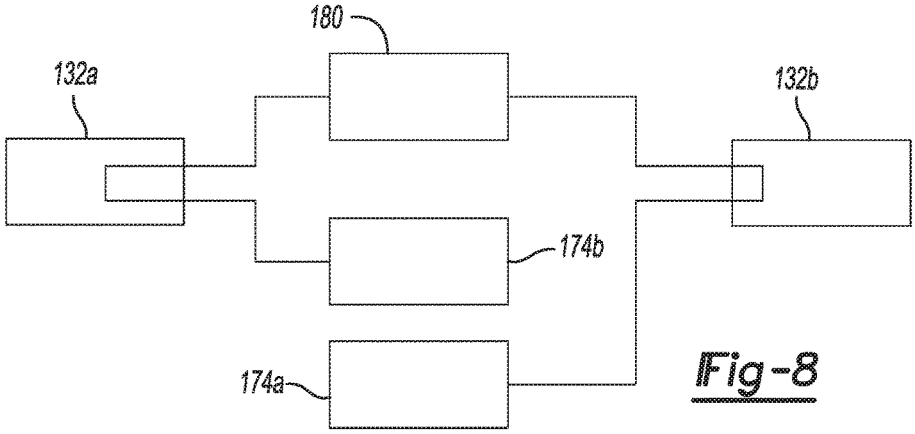
FIG. 8 is a schematic illustration of the capacity modulation assembly of FIG. 1 in a partial reduced-capacity mode.
Figure 9:
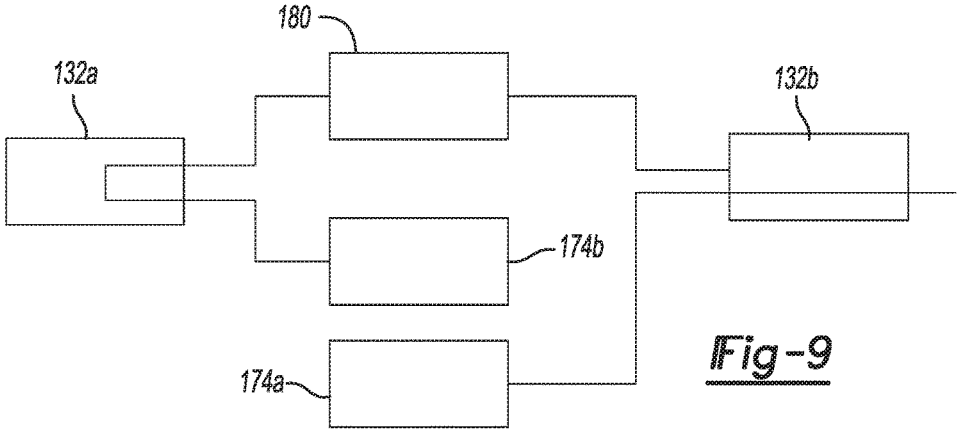
FIG. 9 is a schematic illustration of the capacity modulation assembly of FIG. 1 in a full reduced-capacity mode.

With additional reference to FIGS. 7 through 9, during compressor operation, first and second modulation control valve assemblies 132*a*, 132*b* may each be operated in first and second modes. Accordingly, the compressor 10 may be operated in at least three modes of operation. FIGS. 7 through 9 schematically illustrate operation of first modulation control valve assembly 132*a* and second modulation control valve assembly 132*a* in three modes of operation.

Figure 2A:
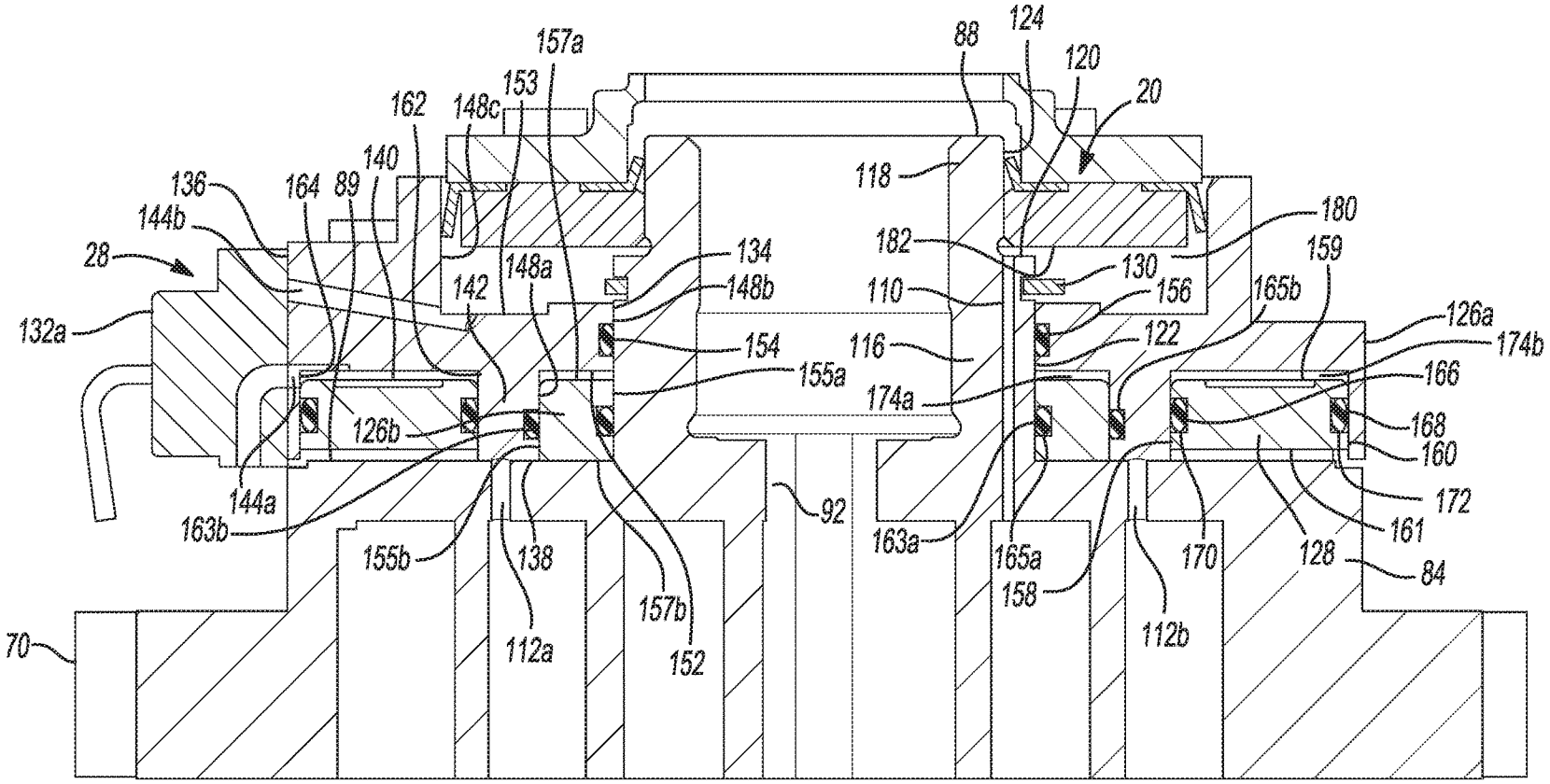
Figure 2B:
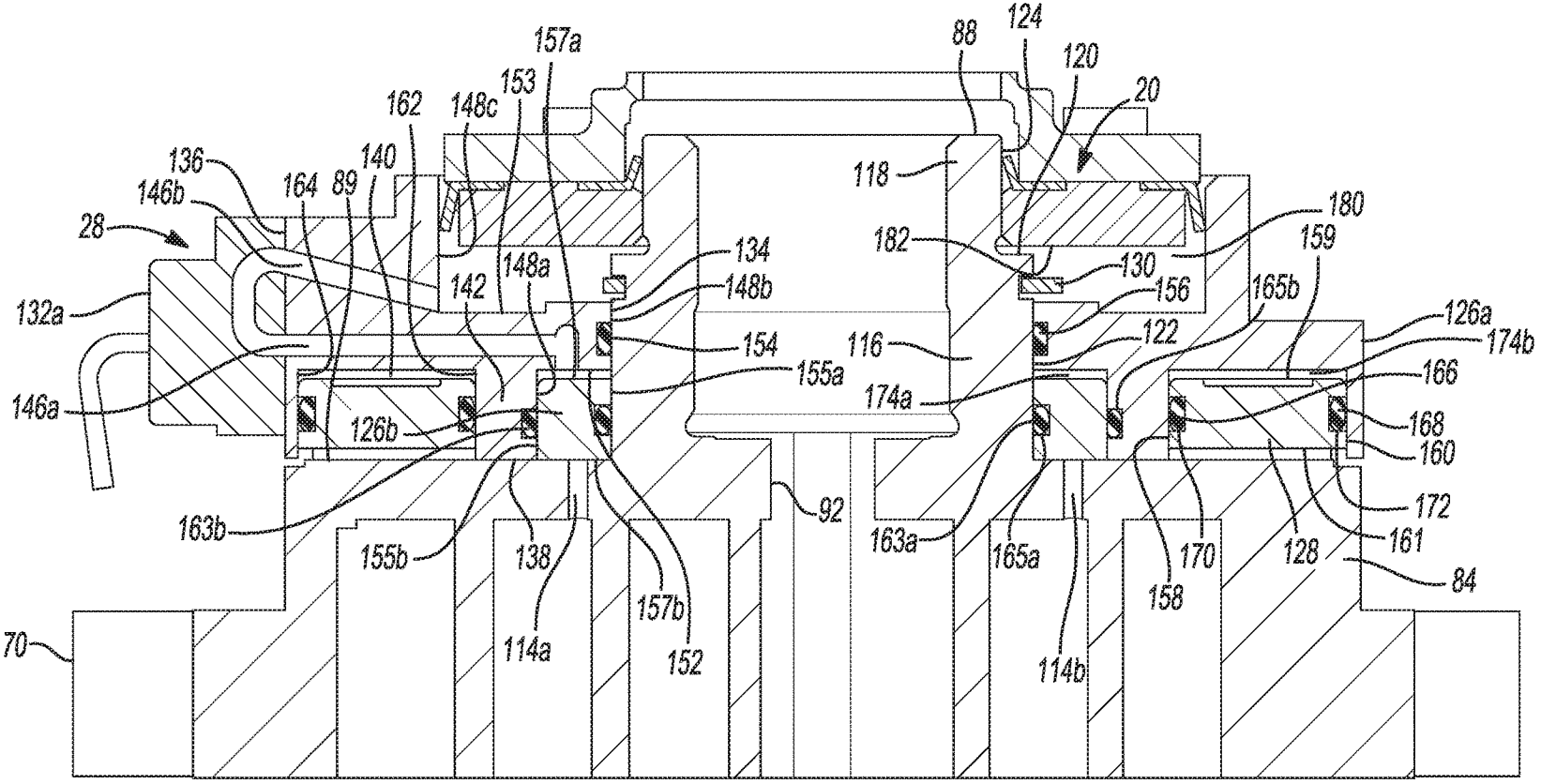

In the first mode, shown in FIGS. 2A, 2B and 7, first modulation control valve assembly 132*a* may provide fluid communication between second modulation control chamber 174*b* and suction pressure region 106, and second modulation control valve assembly 132*b* may provide fluid communication between first modulation control chamber 174*a* and axial biasing chamber 180. More specifically, during operation in the first mode, first modulation control valve assembly 132*a* may provide fluid communication between first passage 144*a* and suction pressure region 106, and second modulation control valve assembly 132*b* may provide fluid communication between third passage 146*a*, fourth passage 146*b*, and axial biasing chamber 180.

Figure 3A:
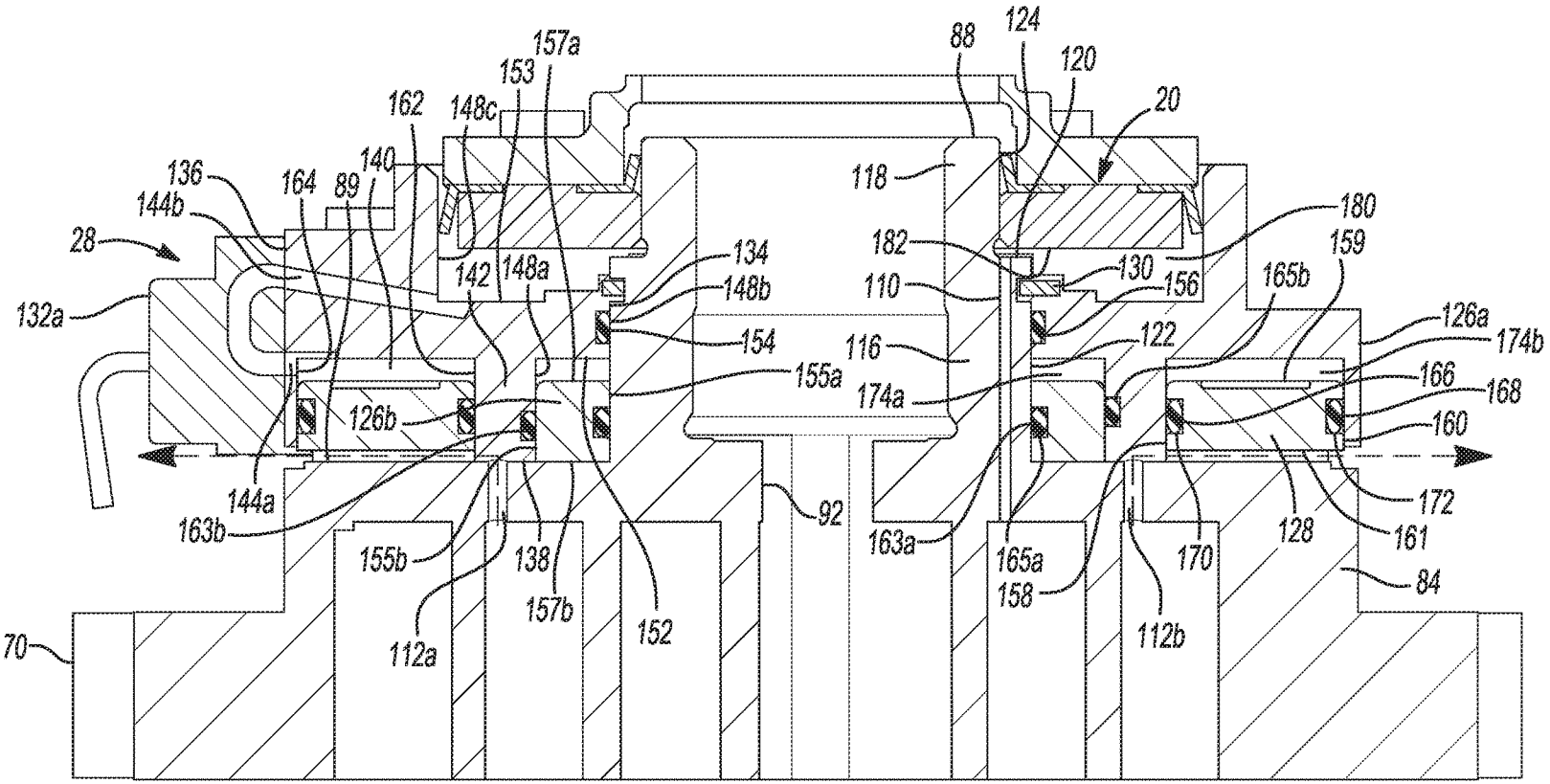
Figure 3B:
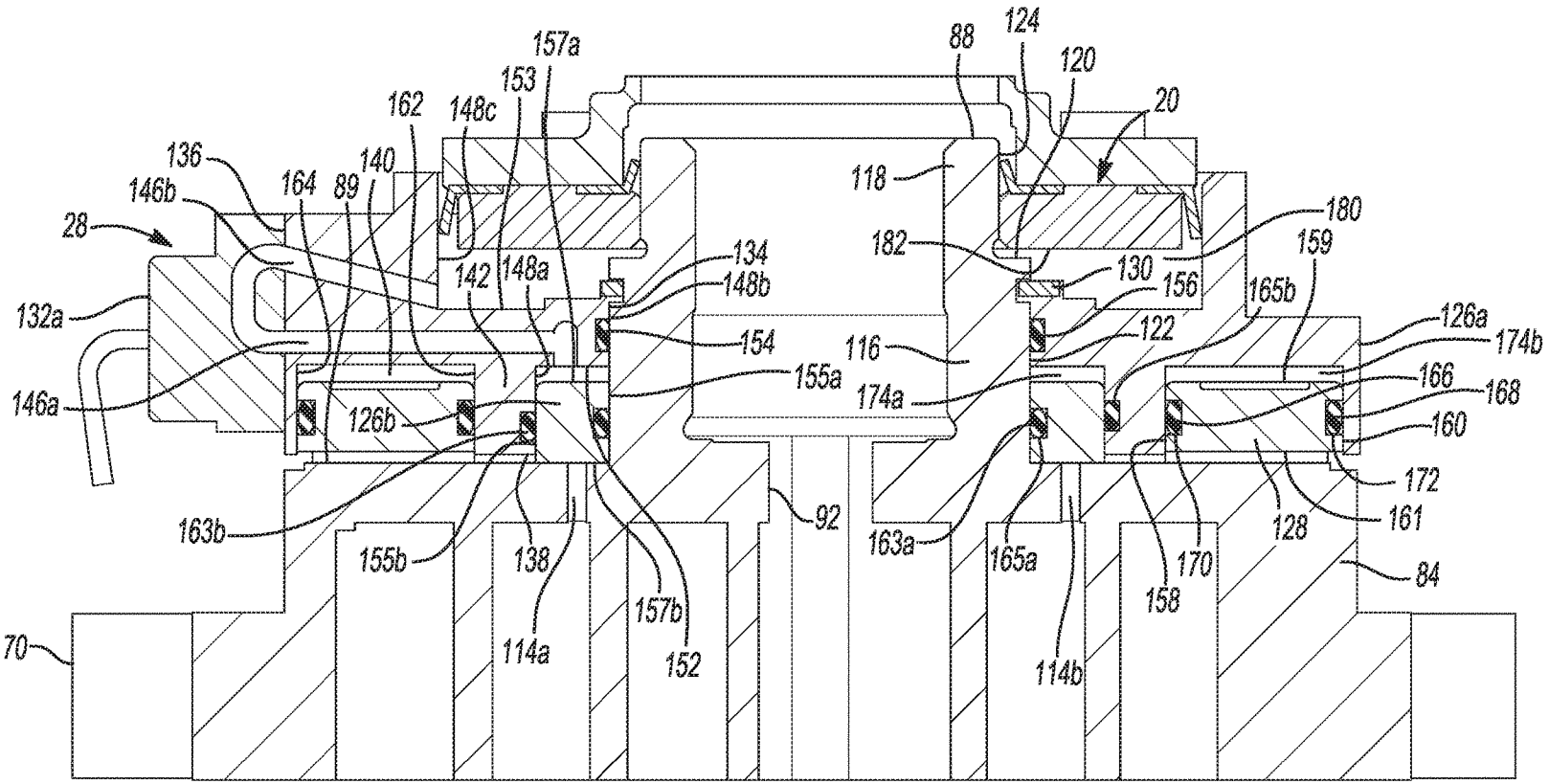

In the second mode, shown in FIGS. 3A, 3B and 8, first modulation control valve assembly 132*a* may provide fluid communication between second modulation control chamber 174*b* and axial biasing chamber 180, and second modulation control valve assembly 132*b* may provide fluid communication between first modulation control chamber 174*a* and axial biasing chamber 180. More specifically, first modulation control valve assembly 132*a* may provide fluid communication between first and second passages 144*a*, 144*b* during operation in the second mode.

Figure 4A:
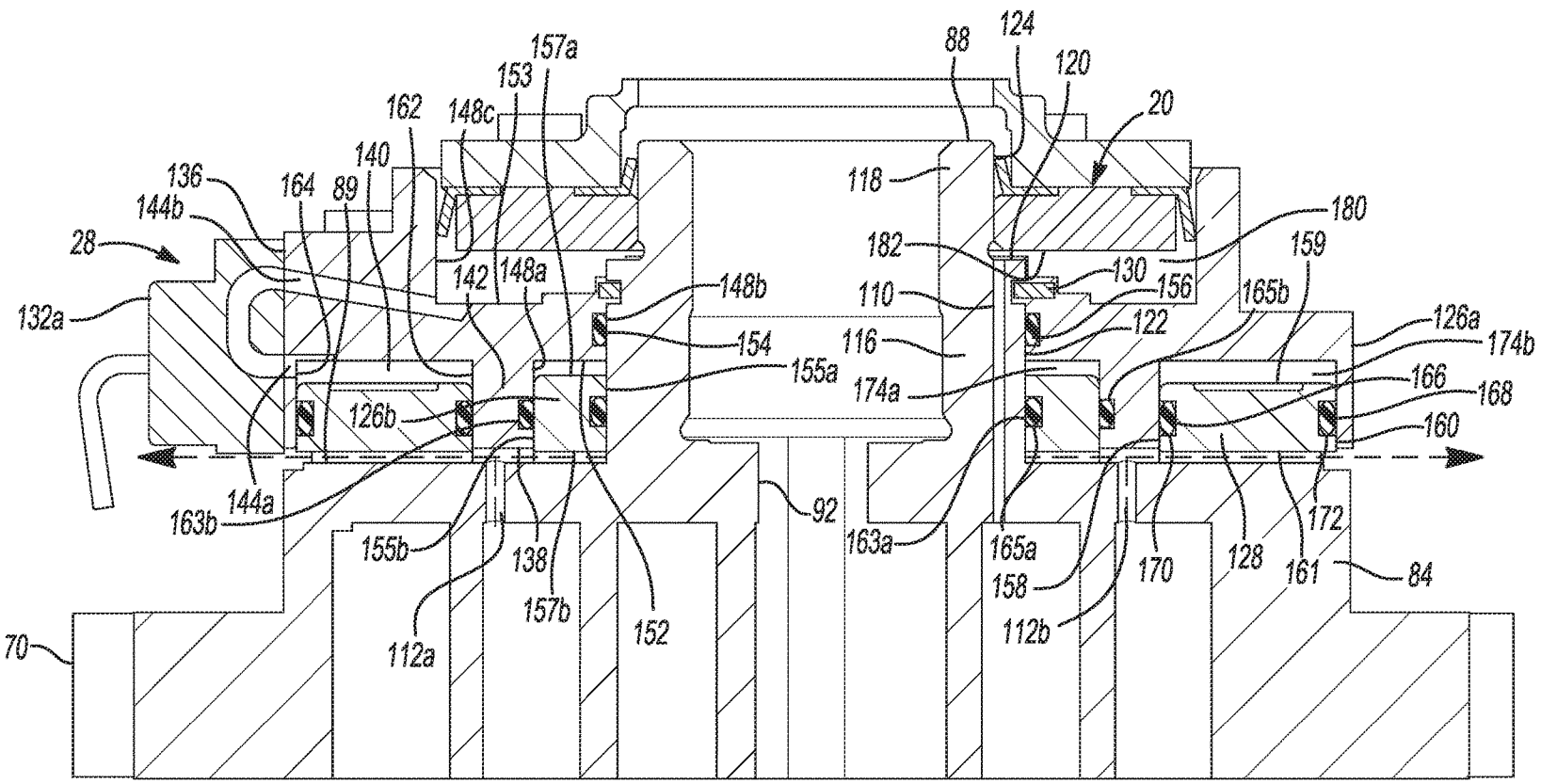
Figure 4B:
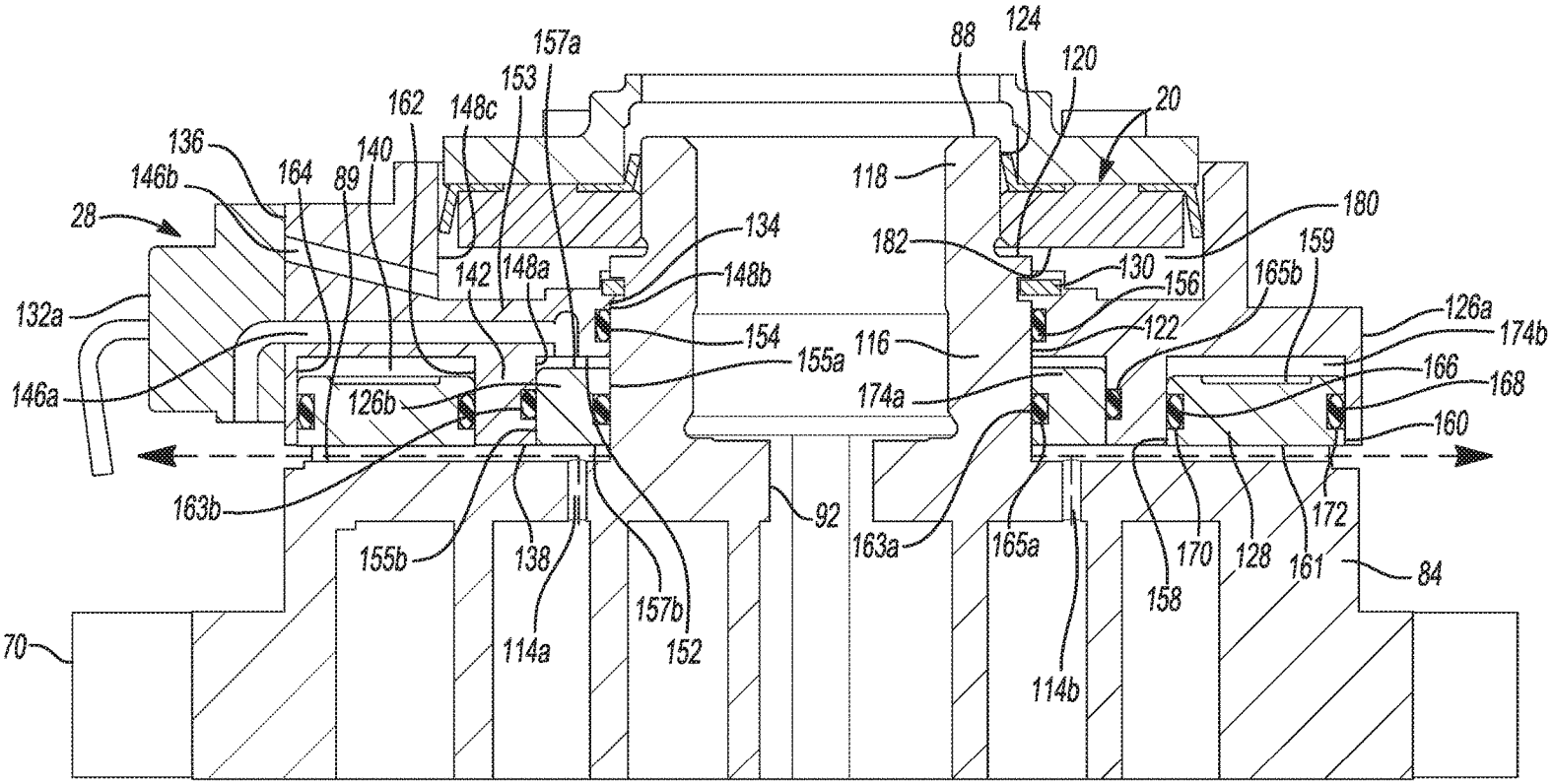

In the third mode, shown in FIGS. 4A, 4B and 9, first modulation control valve assembly 132*a* may provide fluid communication between second modulation control chamber 174*b* and axial biasing chamber 180, and second modulation control valve assembly 132*b* may provide fluid communication between first modulation control chamber 174*a* and suction pressure region 106. More specifically, during operation in the third mode, second modulation control valve assembly 132*a* may provide fluid communication between third passage 146*a* and suction pressure region 106.

First modulation valve ring 126*a* may define a first radial surface area ($A_1$) facing away from non-orbiting scroll 70 radially between second and third portions 148*b*, 148*c* of inner radial surface 134 of first modulation valve ring 126*a* where $A_1=(\pi)(D_5^2-D_4^2)/4$. Inner sidewall 162 may define a diameter ($D_6$) less than a diameter ($D_7$) defined by outer sidewall 164. First modulation valve ring 126*a* may define a second radial surface area ($A_2$) opposite first radial surface area ($A_1$) and facing non-orbiting scroll 70 radially between sidewalls 162, 164 of inner radial surface 134 of first modulation valve ring 126*a* where $A_2=(\pi)(D_7^2-D_6^2)/4$. First radial surface area ($A_1$) may be less than second radial surface area ($A_2$). First modulation valve ring 126*a* may be displaced between first and second positions based on the pressure provided to second modulation control chamber 174*b* by first modulation control valve assembly 132*a*. First modulation valve ring 126*a* may be displaced by fluid pressure acting directly thereon, as discussed below.

Second axial end surface 152 of first modulation valve ring 126*a* may further define a third radial surface area ($A_3$) formed on an opposite side of first modulation valve ring 126*a* than the first radial surface area ($A_1$) and facing non-orbiting scroll 70 radially between the first and second portions 148*a*, 148*b* of first modulation valve ring 126*a* where $A_3=(\pi)(D_3^2-D_4^2)/4$. Third radial surface area ($A_3$) may be less than second radial surface area ($A_2$).

When first and second modulation control valve assemblies 132*a*, 132*b* are operated in the first mode, first and second modulation valve rings 126*a*, 126*b* may each be in respective first positions (FIGS. 2A and 2B). A first intermediate pressure ($P_{i1}$) within axial biasing chamber 180 applied to first radial surface area ($A_1$) may provide a second axial force ($F_2$) operating in a direction opposite the first axial force ($F_1$), urging first modulation valve ring 126*a* axially toward non-orbiting scroll 70. The first intermediate pressure ($P_{i1}$) is supplied to the axial biasing chamber 180 via biasing passage 110. Suction pressure ($P_s$) within second modulation control chamber 174*b* may provide a third axial force ($F_3$) opposite the second axial force ($F_2$), and first intermediate pressure ($P_{i1}$) within first modulation control chamber 174*a* may provide a fourth axial force ($F_4$) opposite the second axial force ($F_2$). Suction pressure ($P_s$) is supplied to second modulation control chamber 174*b* via control valve assembly 132*a* and first passage 144*a* while first intermediate pressure ($P_{i1}$) is supplied via control valve assembly 132*b*, third passage 146*a*, and fourth passage 146*b* to first modulation control chamber 174*a*.

The third and fourth axial forces ($F_3$, $F_4$) may urge first modulation valve ring 126*a* axially away from non-orbiting scroll 70. However, second axial force ($F_2$) may be greater than the combined third and fourth axial forces ($F_3$, $F_4$) even though biasing chamber 180 and control chamber 174*a* are both at intermediate pressure ($P_{i1}$) because second radial surface ($A_2$) is greater than third radial surface area ($A_3$) and control chamber 174*b* is at suction pressure ($P_s$), which is less than intermediate pressure ($P_{i1}$). Fourth axial force ($F_4$) may be greater than the first axial force ($F_1$). Therefore, first and second modulation valve rings 126*a*, 126*b* may each be in the respective first position (FIGS. 2A and 2B) during operation of first and second modulation control valve assemblies 132*a*, 132*b* in the first mode. The first position may include valve portion 142 of first modulation valve ring 126*a* abutting end plate 84 and closing first and second modulation ports 112*a*, 112*b*, and second modulation valve ring 126*b* abutting end plate 84 and closing third and fourth modulation ports 114*a*, 114*b*. This position places the compressor 10 in a full-capacity state, as each port 112*a*, 112*b*, 114*a*, 114*b* is closed, thereby allowing each pocket 94-104 to fully compress fluid disposed therein.

When first and second modulation control valve assemblies 132*a*, 132*b* are operated in the second mode, first modulation valve ring 126*a* may be in a second position, and second modulation valve ring 126*b* may be in the first position (FIGS. 3A, 3B). In the second mode, first intermediate pressure ($P_{i1}$) within second modulation control chamber 174*b* may provide a fifth axial force ($F_5$) acting on first modulation valve ring 126*a* and opposite second axial force ($F_2$) urging first modulation valve ring 126*a* axially away from non-orbiting scroll 70. Because second modulation control chamber 174*b* and axial biasing chamber 180 are in fluid communication with one another during operation of the first modulation control valve assembly 132*a* in the second mode (FIG. 3A) via passages 144*a*, 144*b*, both may operate at approximately the same first intermediate pressure ($P_{i1}$). Fifth axial force ($F_5$) may be greater than second axial force ($F_2$), however, because second radial surface area ($A_2$) is greater than first radial surface area ($A_1$). Therefore, first modulation valve ring 126*a* may be in the second position (FIG. 3A) during operation of first modulation control valve assembly 132*a* in the second mode. The second position may include valve portion 142 of first modulation valve ring 126*a* being displaced from end plate 84 and opening first and second modulation ports 112*a*, 112*b*. First modulation valve ring 126*a* may abut retaining ring 130 when in the second position, as control chamber 174*a* is at first intermediate pressure ($P_{i1}$) via passages 146*a*, 146*b* of control valve assembly 132*a* (FIG. 3B).

First modulation valve ring 126*a* and modulation lift ring 128 may be forced in axial directions opposite one another during operation of first and second modulation control valve assemblies 132*a*, 132*b* in the second mode (FIGS. 3A and 3B). More specifically, first modulation valve ring 126*a* may be displaced axially away from end plate 84 and modulation lift ring 128 may be urged axially toward end plate 84. Protrusions 177 of modulation lift ring 128 may abut end plate 84 and first and second modulation ports 112*a*, 112*b* may be in fluid communication with suction pressure region 106 via radial flow passages 178 when first modulation valve ring 126*a* is in the second position.

When the valve assemblies 132*a*, 132*b* are operated in the second mode (FIGS. 3A and 3B), the compressor 10 is in a reduced-capacity state, as ports 112*a*, 112*b* are opened, thereby preventing the pockets associated with ports 112*a*, 112*b* from fully compressing a fluid disposed therein. Operation of the compressor 10 in this state results in operation of the compressor 10 at approximately seventy percent (70%) of total compressor capacity.

When first and second modulation control valve assemblies 132*a*, 132*b* are operated in the third mode, first and second modulation valve rings 126*a*, 126*b* may each be in their respective second positions (FIGS. 4A, 4B). In the third mode, suction pressure ($P_s$) within first modulation control chamber 174*a* may provide a sixth axial force ($F_6$) acting on second modulation valve ring 126*b* and opposite first axial force ($F_1$) of the biasing members 169. Suction pressure ($P_s$) is supplied to chamber 174*a* via third passage 146*a* of valve assembly 132*a*. First axial force ($F_1$) may be greater than sixth axial force ($F_6$), therefore urging second modulation valve ring 126*b* axially away from non-orbiting scroll 70 under the force of biasing members 169.

In addition, second modulation control chamber 174*b* may be at first intermediate pressure ($P_{i1}$), providing the fifth axial force ($F_5$) acting on first modulation valve ring 126*a*, as described above with respect to the second mode of operation. Therefore, first and second modulation valve rings 126*a*, 126*b* may each be in their respective second positions during operation of first and second modulation control valve assemblies 132*a*, 132*b* in the third mode. The second position of first modulation valve ring 126*a* may include valve portion 142 being displaced from end plate 84 and opening first and second modulation ports 112*a*, 112*b*. The second position of second modulation valve ring 126*b* may include the first axial end surface 157*b* being displaced from end plate 84 and opening third and fourth modulation ports 114*a*, 114*b*. Third and fourth modulation ports 114*a*, 114*b* may be in fluid communication with suction pressure region 106 via radial flow passages 178 when first and second modulation valve rings 126*a*, 126*b* are each in their respective second positions.

When the valve assemblies 132*a*, 132*b* are in the third mode, the compressor 10 is in a reduced-capacity mode, as each modulation port 112*a*, 112*b*, 114*a*, 114*b* is opened, thereby preventing the associated pocket from fully compressing a fluid disposed therein. A capacity of the compressor 10 is less than the capacity of the compressor 10 when the valve assemblies 132*a*, 132*b* are in the second mode. For example, compressor capacity may be at approximately fifty percent (50%) of total compressor capacity.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a first scroll member having an end plate and a spiral wrap extending from said end plate, said end plate including a first modulation port and a second modulation port each in fluid communication with a compression pocket formed by said spiral wrap;

a first modulation valve movable relative to said end plate between a first position blocking said first modulation port and a second position spaced apart from said first modulation port, wherein a first intermediate pressure and a suction pressure act on the first modulation valve to urge the first modulation valve toward the end plate in the first position and a second intermediate pressure acts on the first modulation valve to urge the first modulation valve away from the end plate in the second position; and a second modulation valve movable relative to said end plate between a first position blocking said second modulation port and a second position spaced apart from said second modulation port, wherein a first axial force urges the second modulation valve axially away from said end plate and into said second position and second intermediate pressure urges said second modulation valve toward said end plate in said first position.

2. The compressor of claim 1, wherein the first modulation valve is a valve ring and the second modulation valve is a valve ring.

3. The compressor of claim 1, wherein, said second modulation valve is located radially inward from said first modulation valve.

4. The compressor of claim 1, wherein said first intermediate pressure is the same as said second intermediate pressure.

5. The compressor of claim 4, wherein said first intermediate pressure is supplied through a biasing passage in communication with another compression pocket formed in said spiral wrap.

6. The compressor of claim 4, wherein said suction pressure is supplied though a first passage in communication with a first control valve assembly, wherein said first control valve assembly selectively provides suction pressure to said first passage.

7. The compressor of claim 4, wherein said second intermediate pressure is supplied through a second passage in communication with a second control valve assembly, wherein said second control valve assembly selectively provides intermediate pressure to said second passage.

8. The compressor of claim 1, wherein a biasing member applies said first axial force on said second modulation valve.

9. The compressor of claim 8, wherein the biasing member is a helical spring disposed within a bore in said second modulation valve.

10. The compressor of claim 1, wherein said first modulation valve and said second modulation valve provide three modes of modulation, said first modulation valve being in said first position and said second modulation valve being in said first position in said first mode of modulation, said first modulation valve being in said second position and said second modulation valve being in said first position in said second mode of modulation, and said first modulation valve being in said second position and said second modulation valve being in said second position in said third mode of modulation.

11. The compressor of claim 1, wherein said first scroll member includes a discharge port formed through said end plate, said second modulation valve disposed between said first modulation valve and said discharge port.

12. A compressor comprising:

a first scroll member having an end plate and a spiral wrap extending from said end plate, said end plate including a first modulation port and a second modulation port each in fluid communication with a compression pocket formed by said spiral wrap;

a first modulation valve movable relative to said end plate between a first position blocking said first modulation port and a second position spaced apart from said first modulation port, wherein said first modulation valve is moved between said first position and said second position by pressurized fluid received in a first control chamber;

a second modulation valve movable relative to said end plate between a first position blocking said second modulation port and a second position spaced apart from said second modulation port, wherein said second modulation valve is moved between said first position and said second position by pressurized fluid received in a second control chamber formed between said first modulation valve and said second modulation valve.

13. The compressor of claim 12, wherein said first modulation valve is a valve ring and said second modulation valve is a valve ring.

14. The compressor of claim 12, further comprising a modulation lift ring disposed between said first modulation valve and said first scroll member, said modulation lift ring cooperating with said first modulation valve to form said first control chamber operable to receive pressurized fluid to move said first modulation valve ring between said first position and said second position.

15. The compressor of claim 12, wherein said second control chamber is selectively supplied with intermediate-pressure fluid to move said second modulation valve ring into said first position and is selectively supplied with suction-pressure fluid to move said second modulation valve ring into said second position.

16. The compressor of claim 15, wherein said first control chamber is selectively supplied with suction-pressure fluid to move said first modulation valve into said first position and is selectively supplied with intermediate-pressure fluid to move said first modulation valve into said second position.

17. The compressor of claim 16, further comprising an axial biasing chamber supplying said intermediate-pressure fluid to said first modulation control chamber and said second modulation control chamber.

18. The compressor of claim 17, wherein said axial biasing chamber is at least partially defined by said first modulation valve ring.

19. The compressor of claim 16 further comprising a first control valve assembly operable to control flow of said suction-pressure fluid and said intermediate-pressure fluid into said second modulation control chamber and a second control valve assembly operable to control flow of said suction-pressure fluid and said intermediate-pressure fluid into said first modulation control chamber.

20. The compressor of claim 12, wherein said first scroll member includes a discharge port formed through said end plate, said second modulation valve ring disposed between said first modulation valve ring and said discharge port.

* * * * *